US006422196B1

(12) United States Patent
Pien

(10) Patent No.: US 6,422,196 B1
(45) Date of Patent: Jul. 23, 2002

(54) PISTON ENGINE POWERTRAIN

(76) Inventor: Pao Chi Pien, Marbelle Club, 840 S. Collier Blvd., Marco Island, FL (US) 34145

( * ) Notice: Subject to any disclaimer, the term of this patent is extended or adjusted under 35 U.S.C. 154(b) by 163 days.

(21) Appl. No.: 09/698,113

(22) Filed: Oct. 30, 2000

(51) Int. Cl.[7] ..... F02B 77/00
(52) U.S. Cl. ..... 123/198 F; 123/197.4
(58) Field of Search ..... 123/198 F, 197.4

(56) References Cited

U.S. PATENT DOCUMENTS 902,692 A * 11/1908 Sherman ..... 123/198 F

* cited by examiner

*Primary Examiner*—Noah P. Kamen

(74) *Attorney, Agent, or Firm*—Roy W. Butrum; Dykema Gossett, PLLC

(57) ABSTRACT

An engine body supports a cylinder having a piston reciprocally mounted therein. An auxiliary inlet valve is provided for introducing compressed air into the cylinder above the piston. A connecting rod is pivotally connected between the piston and a lever which is pivotally supported by the engine body. The lever rotatably supports a drive roller which is disposed in contact with a cam surface on a member drivingly connected to an output shaft. The lever is formed of strong elastic material and an operating device selectively locks the lever in a first position where the drive roller is out of contact with the cam surface and in a second position where the lever is deformed so as to act as a bar spring to urge the roller into continuous contact with the cam surface as the output shaft and member connected thereto rotate. A plurality of cylinders and associated components are disclosed including a six cylinder engine arranged in three rows of two cylinders each and two columns of three cylinders each.

20 Claims, 5 Drawing Sheets

PISTON ENGINE POWERTRAIN

BACKGROUND OF THE INVENTION

The present invention relates to a piston engine powertrain, and more particularly to a powertrain which transmits power from a piston of an internal combustion engine to an output shaft. This invention is an improvement over the powertrain disclosed in pending U.S. patent application Ser. No. 09/377,863, filed Aug. 20, 1999.

Modern mid-size sedans can maintain a highway speed of 70 mph with only one-third of the installed engine power. Full power is required only for quick acceleration and climbing a steep slope. Therefore, it is desirable to provide a powertrain which permits one or more cylinders to be deactivated when power is not needed and which enables the deactivated cylinders to be reactivated to restore power quickly when power is required. On average, each cylinder will then operate only one-third of time, and therefore engine life is increased three fold.

For a given maximum pressure, a constant-pressure cycle compression-ignition (CI) engine has a higher efficiency, a greater specific power, and a lower firing temperature than either a constant-volume or limited-pressure cycle engine. The firing temperature at the end of a constant pressure combustion process can be limited by selecting an appropriate compression ratio instead of recycling the exhaust gas (EGR). The lost cycle efficiency due to limited firing temperature can be recovered with a much larger expansion ratio than compression ratio. Therefore, it is desirable to have a powertrain which enables the coordination of piston movement with the rate of fuel injection to obtain constant pressure combustion. At the same time, the powertrain can provide two different piston strokes, a short stroke for intake and compression processes and a long stroke for expansion and exhaust processes.

In the case of a conventional piston-crank assembly powertrain in which the piston is permanently connected to a crankshaft, only stopping the engine can stop piston motion. The same crank radius determines the length of both the compression and expansion strokes, and therefore the length of the two strokes cannot differ. The traditional piston-crank assembly powertrain should accordingly be replaced by an alternative powertrain. Of the available alternative powertrain, the piston-cam assembly powertrain offers the greatest potential for achieving the desired results. As early as 1927, The Fairchild-Caminez 4-cylinder engine with a piston-cam assembly powertrain was built and successful endurance tested. However, such a prior art powertrain needs modification for present purposes.

SUMMARY OF THE INVENTION

The present invention is an advanced piston-cam assembly powertrain similar to that shown in U.S. patent application Ser. No. 09/377,863, now Pat. No. 6,125,802, but with certain elements modified to provide unique improved results. The present invention incorporates two separate parts, namely a reciprocating part and a rotary part. The reciprocating part includes a piston, connecting rod and lever. The lever of the invention is formed of a strong elastic material such as spring steel for a purpose hereinafter described. The lower end of the connecting rod is pivotally connected to the free end of a lever to define a pivot axis. A drive means in the form of two spaced rollers is mounted on the free end of the lever for rotation about the aforementioned pivot axis. The other end of the lever is pivotally supported on the engine body. The rotary part of the invention includes a member which is drivingly connected to a rotatable output shaft and has a cam surface formed thereon. The cam surface defines a profile having two lobes with different base circles which produces two different piston strokes comprising a short stroke for intake and compression processes and a long stroke for expansion and exhaust processes.

The pivotally supported end of the lever can be locked in two different operative positions. In one operative position, the lever is straight and the drive rollers are disposed out of contact with the cam surface so that the associated piston does not reciprocate within its cylinder in the engine body, and accordingly the cylinder is deactivated. In the other operative position, the lever is bent and the drive rollers are disposed in continuous contact with the cam surface so that the associated piston does reciprocate within its cylinder, and accordingly the cylinder is activated. When the lever is in this other operative position, the lever is elastically deformed and the lever acts as a bar spring to urge the drive means into contact with the cam surface on the member drivingly connected to the output shaft. The cylinder is provided with an auxiliary inlet valve for introducing compressed air into the cylinder above the piston to ensure that the drive rollers are maintained in continuous contact with the cam surface during certain periods of operation of the invention.

As the piston reciprocates within the bore of an activated cylinder, the piston power is transmitted through the connecting rod to the free end of the lever and the drive means or rollers carried thereby. The power is thence transmitted by the drive means to the cam surface on the member drivingly connected to the output shaft and to the output shaft itself. The cylinder has a centerline, and the components are so constructed and arranged that the lower end of the connecting rod deviates very little from the centerline of the cylinder during reciprocation of the piston within the cylinder. Side forces generated between the drive means and the cam surface are transmitted through the lever to the engine body instead of through the piston and cylinder wall as occurs with convention powertrains.

The invention advanced piston-cam assembly powertrain can achieve a combustion process under constant pressure by coordinating the rate of fuel injection with a desired piston movement produced by choosing an appropriate cam profile. Then, instead of reducing NOx formation by recycling exhaust gas (EGR), the invention offers a superior means for lowering maximum firing temperature by choosing an appropriate compression ratio such that at the end of a constant pressure combustion process, the firing temperature is within the allowable limit. Lost cycle efficiency, due to lowered firing temperature can be compensated for by an overexpanded cycle when the invention powertrain is used.

The above discussion relates to a single cylinder along with its associated components. However, in most practical applications, a plurality of cylinders are employed, a six cylinder being described in detail hereinafter. When multiple cylinders are utilized, each cylinder is individually mounted on the engine body or frame. The rotating part of the powertrain including the member and the drivingly connected output shaft have sufficient mass and angular momentum to function as a flywheel. The output shaft is supported on spaced ball bearings, and needle bearings can be used to reduce friction at each end of the connecting rod. The only sliding motion is between the short piston skirt and the cylinder wall where normal forces are very small. Therefore, engine friction losses are small and mechanical efficiency is very high. A light reciprocating mass and small piston frictional resistance allow a much higher piston speed to further boost engine specific output. Since the invention powertrain eliminates an expensive crankshaft, a separate camshaft and a gear train, the manufacturing cost of a new engine is greatly lowered.

In urban areas where the speed limit is well below 70 mph, only one cylinder of a multi-cylinder engine is sufficient to meet the power requirement. The one cylinder operation providing one power stroke per engine revolution is equivalent to a conventional 2-cylinder engine thereby providing a most effective way to minimize air pollution in the city. An electronic device based on information from a torque sensor on the power output shaft can be used to determine which cylinder or cylinders should be activated to meet the power requirements as well as to distribute the operation equally among all of the cylinders. On average, only one-third of all cylinders in a 6-cylinder engine will be activated, and thus the engine can last three times longer than a conventional engine design. Eventually, the number of automotive engine manufactures and related factories to keep the same number of automobiles on the road could be greatly reduced. A new engine, which can last three times longer, can be obtained by combining the advanced powertrain of the invention with the conventional piston-cylinder assembly of a CI engine.

The biggest advantage of a piston-cam assembly powertrain over conventional piston-crank assembly powertrains is the fact that piston speed is an independent variable. As the shaft rotates, piston speed is not determined by engine rpm but by a cam profile which can be varied as desired to make the piston speed an independent variable. For a given maximum cycle pressure, a constant-pressure cycle CI engine has higher efficiency, a greater specific power, and a lower firing temperature than either a constant-volume or limited-pressure cycle engine. Accordingly, for improved engine performance a 4SDI engine should be designed to operate on a constant-pressure cycle. At the same time, in order to reduce in-cylinder NOx formation, a 4SDI engine must also operate under a limited temperature cycle. The key to achieving both goals simultaneously is to develop an appropriate cam profile to achieve a composite combustion process with a constant pressure portion to achieve high engine performance and a limited temperature portion to reduce the in-cylinder NOx emission to a predetermined level. For diesel engines utilizing a piston-crank assembly powertrain, 95% of heat release is accomplished within about 35 degrees of crank angle. In a piston-cam assembly powertrain, a larger cam profile section can be arbitrarily allocated to fuel injection/combustion to prolong the combustion process. As a result, better fuel-air mixing and more complete combustion can be achieved to reduce levels of particulates, CO, and unburned hydrocarbons. The longer duration for fuel injection/combustion has the effect of reducing the effective expansion ratio. To boost engine performance, a larger expansion piston stroke can be chosen to operate the engine with an over-expanded cycle. The powertrain of the invention can accomplish the required characteristics of a combustion process to improve engine performance and to lower in-cylinder emission levels.

DESCRIPTION OF THE PREFERRED EMBODIMENT

Figure 1:
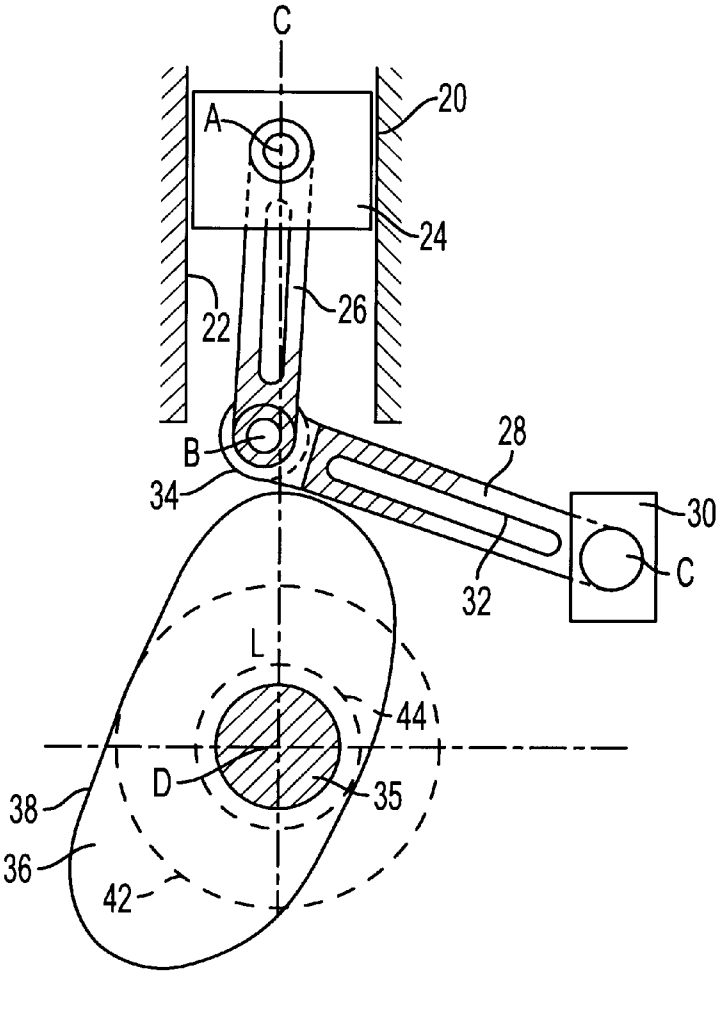
FIG. 1 is a diagrammatic view of the invention powertrain showing a deactivated cylinder.

Referring now to the drawings wherein like reference characters designate corresponding parts throughout the several views, there is shown in FIG. 1 a cylinder 20 formed in an engine body and defining a bore 22 therein. The cylinder has a centerline CL. A piston 24 is mounted for reciprocation within the bore of the cylinder and is pivotally connected to the upper end of connecting rod 26 for pivotal movement about an axis A. The lower end of the connecting rod is pivotally connected to a free end of a lever 28 for pivotal movement about an axis B. The opposite end of the lever is pivotally connected to an operating means 30 for pivotal movement about an axis C. It is noted that axes A, B and C are parallel with one another. Operating means 30 is supported by the engine body and may comprise a rotary solenoid or a servo-mechanism to lock the lever in either of two operative positions as hereinafter described.

Lever 28 is formed of a strong elastic material such as spring steel so that it acts as a bar spring when deformed during operation of the powertrain. The lever has a wide flange I-beam cross-section with a portion of the connecting web removed to form the elongated slot 32 therein. The lever may have other cross-sectional configurations, if so desired. Drive means in the form of a pair of similar spaced drive rollers are is rotatably supported on the lever for rotation about axis B. One of the drive rollers 34 is visible in FIG. 1

Figure 6:
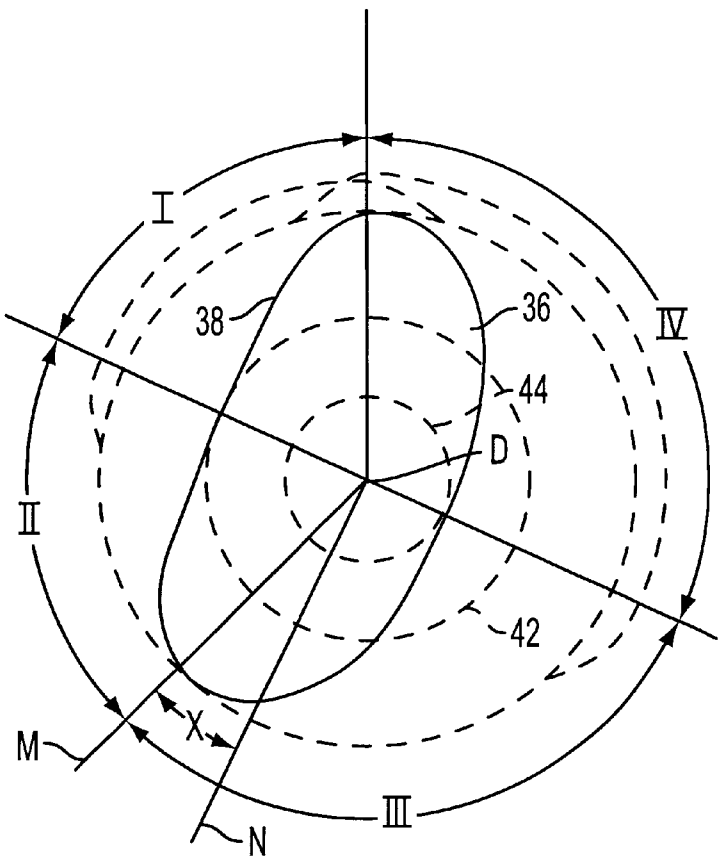
FIG. 6 is a diagrammatic view illustrating the configuration of the outer surface on the member drivingly connected to the output shaft as well as the shaft angle allocations for various cycle processes.

An output shaft 35 is rotatable about an axis D and is drivingly connected to a member 36 having a peripheral cam surface 38 formed thereon. As shown in FIG. 1, the cylinder is deactivated and lever 28 has been pivoted in a clockwise direction into a first operative position and locked in such position by operating means 30 with the drive rollers 34 out of contact with cam surface 38 so that there is no driving connection between the rollers and member 36. Cam surface 38 has a cam profile to provide an overexpanded operating cycle. The profile of cam surface 38 as seen in FIG. 6 consists of four sections I, II, III and IV corresponding to intake, compression, expansion and exhaust strokes respectively. The cam profile has two base circles 42 and 44 with different diameters, the profile 38 including two lobes. Cam profile sections I and II with the larger base circle 42 provide shorter intake and compression strokes, while sections III and IV with the smaller base circle 44 provide longer expansion and exhaust strokes. At the beginning of section III, angle X between two radial lines M and N passing through axis D of the output shaft defines a chosen time period for fuel injection/combustion, and the contour of cam surface 38 between lines M and N is designed to achieve the required firing pressure and temperature. Therefore, the invention powertrain enables the time period for fuel injection/combustion to be freely chosen while achieving the required firing pressure and temperature.

Figure 1A:
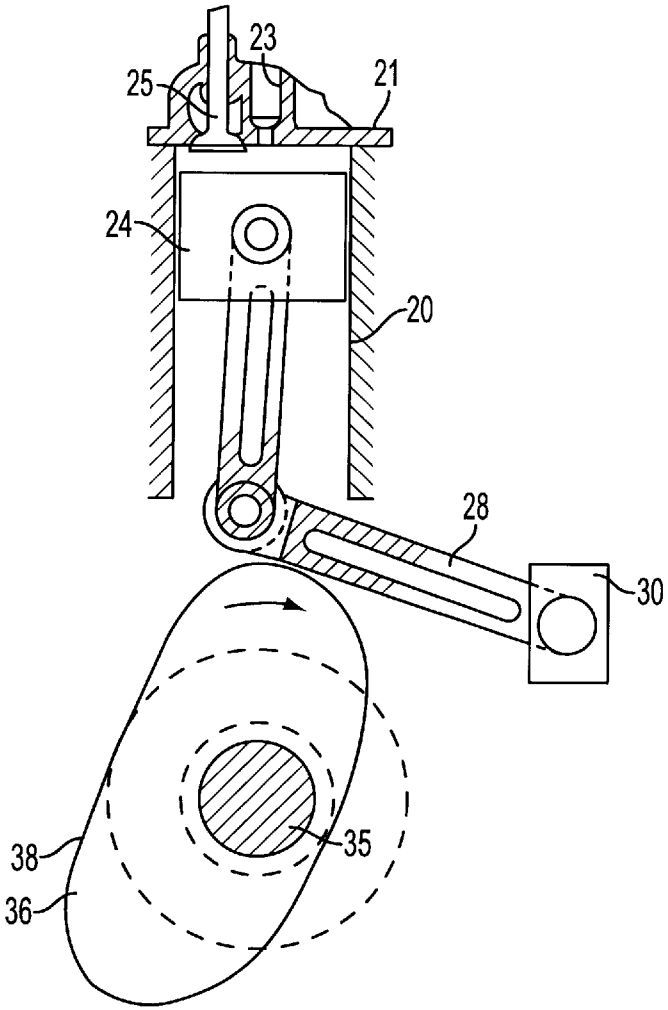
FIG. 1A is a view similar to FIG. 1 showing the cylinder with a cylinder head and auxiliary inlet valve.

Referring to FIG. 1A, cylinder 20 includes a cylinder head 21 having a conventional fuel injector 23 mounted thereon. The conventional inlet and exhaust valves disposed at the cylinder head are not shown for the purpose of illustration, but operate in the normal manner. An auxiliary inlet valve 25 is mounted on the cylinder head and is connected to a small air tank (not shown) which contains moderately compressed air which may be at a pressure of about 30 psi. A conventional solenoid (not shown) is operatively connected to valve 25 to cause the valve to open and close at predetermined times during operation of the powertrain and the associated engine. A conventional torque sensor (not shown) is operatively associated with the output shaft 35 for controlling the operation of the solenoid connected to valve 25.

Assuming that the cylinder has been deactivated, when the shaft angle of output shaft 35 corresponds to the end of a compression process, the cylinder can be activated by releasing operating means 30 at the pivotally mounted end of lever 28 from the first locked position shown in FIG. 1. Simultaneously, auxiliary inlet valve 25 is opened by the associated solenoid to admit compressed air into the top of cylinder 20. This compressed air pushes piston 24 rapidly downwardly to the position shown in FIG. 4 which corresponds to the end of an expansion process. The compressed air ensures that the drive rollers remain in contact with the cam surface 38 during this period of operation. When the components reach the position shown in FIG. 4, operating means 30 is operated to lock the pivotally mounted end of lever 28 in a second locked position.

Figure 2:
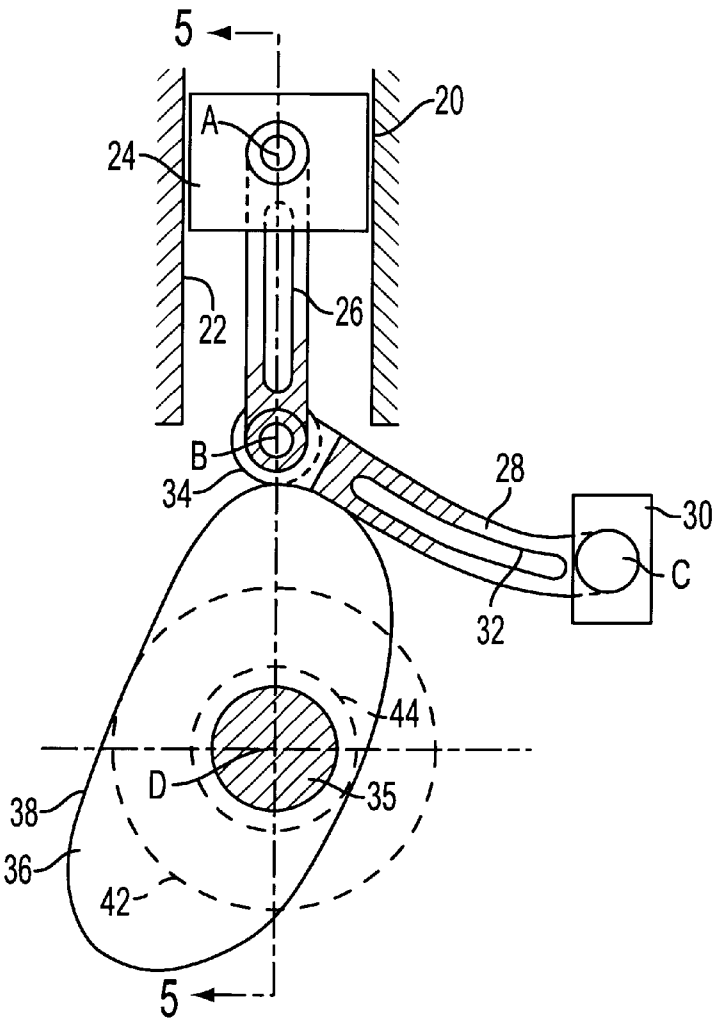
FIG. 2 is a diagrammatic view of the powertrain showing an activated cylinder.

Auxiliary valve 25 is closed by operation of the associated solenoid before the piston 24 is pushed upward and before the exhaust valve of the cylinder opens. Piston 24 is pushed upward by cam surface 38 on member 36 to the position shown in FIG. 2 which corresponds to the end of an exhaust process. To deactivate the cylinder, operating means 30 unlocks lever 28 from the second locked position when the piston is at the end of an expansion stroke in the position shown in FIG. 4 and piston 24 is pushed upward by cam surface 38 on member 36 to the position shown in FIG. 1. It is noted that the inertia of piston 24 and the components movable therewith is sufficient to carry these components into the FIG. 1 position wherein the drive rollers 34 are out of contact with the cam surface. The operating means 30 is then operated by the associated solenoid to lock the pivotally mounted end of lever 28 in the first locked position. The deformed lever functions as a bar spring with sufficient spring force to maintain the drive rollers in contact with cam surface 38 as long as the cylinder is activated.

As the piston reciprocates within the activated cylinder, power is transmitted through the connecting rod to the drive rollers which roll on the cam surface of member 36 to cause rotation of member 36 and the output shaft 35. During operation of the powertrain the axis B deviates very little from centerline CL as the piston reciprocates and side forces generated between the drive means and the cam surface are transmitted through the lever to the engine body through the operating means 30.

It should be noted that auxiliary valve 25 opens and closes only once when a cylinder is activated. The cylinder is activated and deactivated very quickly. Therefore, automatic change in engine power as governed by a torque sensor operatively associated with the output shaft can be accomplished much faster than operating a conventional accelerator pedal by the foot of a driver. This factor may have some significance for racing car engines. To start such engines, the rotating part of the powertrain may be cranked up to a high rpm before one or more cylinders are activated. Since the heat loss during the first fast compression process is very small, the ensuing fuel injection immediately initiates a combustion process to start the engine regardless of the weather conditions.

Figure 5:
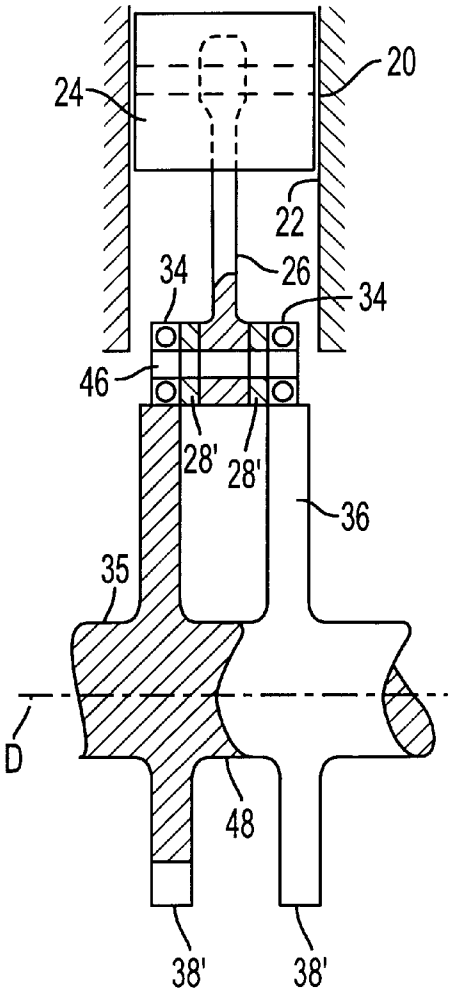
FIG. 5 is a sectional view partly broken away taken along line 5—5 of FIG. 2.

Referring to FIG. 5, the lower end of connecting rod 26 carries a pin 46 which extends through suitable holes formed in the bifurcated end 28' of the lever to pivotally connect the connecting rod and lever to one another. The outer ends of pin 46 carry the drive rollers 34. Member 36 has an annular groove 48 formed in the central portion of the cam surface thereon to define a space for receiving lever 28 during certain periods of operation of the powertrain and forming two spaced identical cam surface portions 38' thereon. One of drive rollers 34 is engageable with one of the cam surface portions 38', and the other of the drive rollers is engageable with the other of the cam surface portions.

Figure 4:
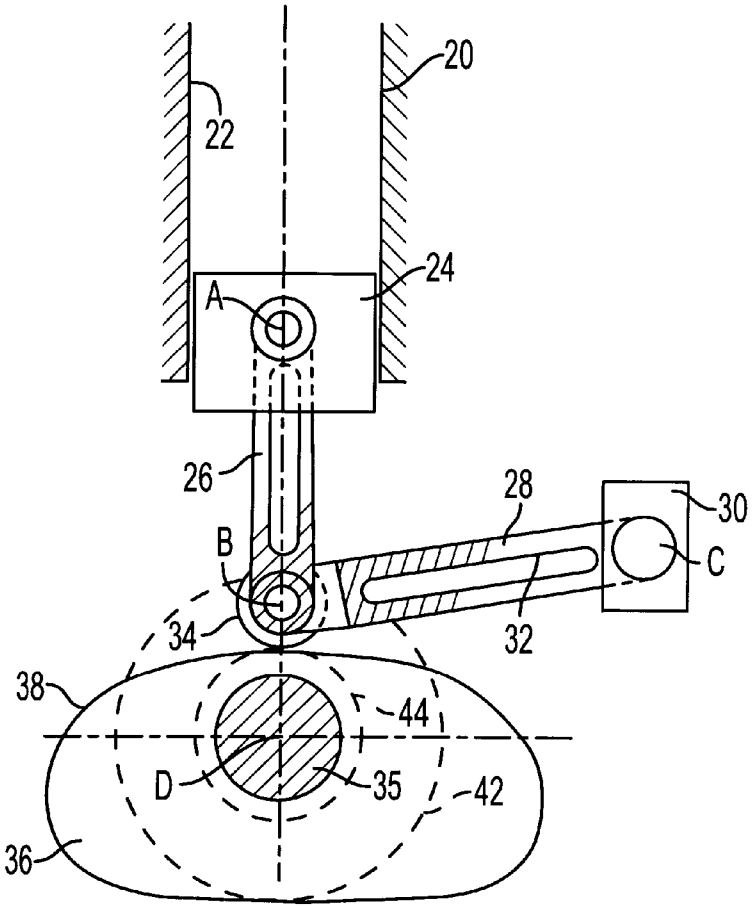
FIG. 4 is a diagrammatic view of the powertrain showing the position of the piston at the end of an expansion stroke.
Figure 3:
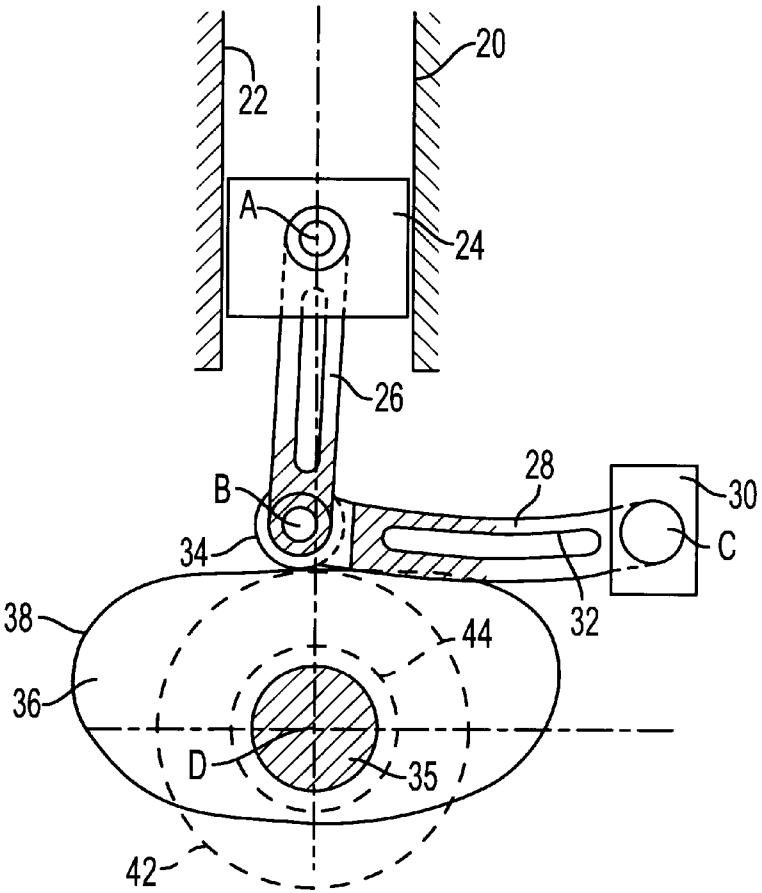
FIG. 3 is a diagrammatic view of the powertrain showing the position of the piston at the beginning of a compression stroke.

FIG. 3 shows the position of the powertrain components when the piston is at the beginning of a compression stroke. FIG. 4 shows the position of the powertrain when the piston is at the end of an expansion stroke. It is apparent that because of the unequal base circles, the expansion stroke is larger than the compression stroke. When the cylinder is activated, the spring force in the bent lever is large enough to keep the drive rollers in contact with the cam surface during an intake stroke. During the rest of the engine cycle, high gas pressure on top of the piston automatically keeps the drive rollers in contact with cam surface 38.

Additional valve operating cam surfaces may be formed on the periphery of member 36 at the opposite faces thereof. These additional cam surfaces may include cam lobes for engaging rollers on push rods to operate intake and exhaust valves respectively which are associated with the cylinder.

The profile of cam surface 38 has two lobes and two different base circles to generate two different strokes. A larger portion of shaft angle is allocated to a longer stroke, so that the average piston speed over all four strokes are about equal. Each rotation of the output shaft generates four piston strokes, while the intake and exhaust valves open and close once. Therefore, the additional valve operating cam surfaces rotate at the same speed as the cam surface 38. The rocker arms of the valve operating mechanism extend parallel to the output shaft. For achieving a long valve opening duration, the additional cam surfaces have a large base circle with circular arc lobe profiles. As a result, high volumetric efficiency is obtained with less pumping losses.

An existing 4SDI diesel engine can be designed to operate on a constant-pressure cycle when its piston-crank assembly powertrain is replaced with the invention powertrain. For engine performance, a 4SDI engine can be designed to operate on a constant-pressure-overexpanded cycle. For reducing in-cylinder NOx emission to a low level, the engine should also operate under a limited temperature. With combustion chamber volume as an independent variable, it is possible to achieve a combustion process under a constant pressure at the beginning portion of the process and a limited firing temperature near the end of the process. The cam profile portion required to achieve such a combustion process can be obtained from an indicator diagram with pressure as well as experimental firing temperature plotted against the volume. Based on extended engine durability considerations, a constant pressure line is drawn on the indicator diagram. A limited temperature line is also drawn below which in-cylinder NOx formation is negligible. Any point above the constant pressure or limited temperature line is lowered to the line by an adiabatic expansion of the gas in the combustion chamber. A polar coordinate plot of combustion chamber new volume against the rotating angle of a power output camshaft is constructed such that the time period of fuel injection/combustion is the same as before. From this plot, piston positions from the top dead center position are determined and the required cam profile portion for fuel injection/combustion is derived.

Due to longer fuel injection/combustion duration, effective expansion ratio is reduced. To boost engine performance, a larger expansion piston stroke can be chosen for the engine to operate on an overexpanded cycle. A larger cam profile portion can be arbitrarily allocated to fuel injection/combustion to prolong a combustion process. As a result, better fuel-air mixing and more complete combustion can be achieved to reduce levels of particulates, CO and unburned hydrocarbons.

Figure 7:
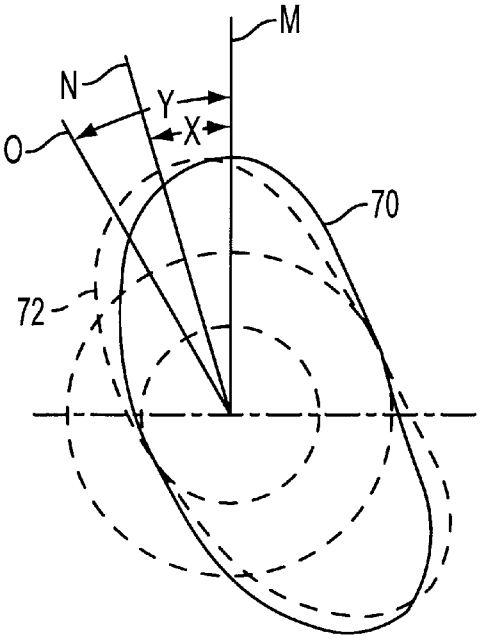
FIG. 7 is a view showing two different cam surface configurations for high rpm and low rpm engines respectively to achieve a constant pressure and limited temperature combustion process in a diesel engine.

The combination of fuel injection pattern and cam profile portion necessary to achieve a constant pressure and limited temperature combustion process can be maintained for any rpm as long as the fuel injection/combustion time period is kept constant. In other words, the cam profile portion allocated to fuel injection/combustion is proportional to the engine rpm. As seen in FIG. 7, a first cam profile 70 shown in a solid line is designed for a lower rpm and a second cam profile 72 shown in a dotted line is designed for a higher rpm. Two radial lines M and N define a shaft angle X therebetween during which fuel injection/combustion takes place when cam profile 70 is used. If the rpm is increased without changing the fuel injection time rate, the combustion process will be altered. Radial lines M and 0 define a shaft angle Y therebetween during which fuel-injection/combustion takes place when cam profile 72 is used. The angular coordinate of the cam profile defined between lines M and O is greater than that of the cam profile defined between lines M and N by the same ratio as the ratio between the higher rpm and lower rpm of engine operation. In this manner, the time periods for fuel injection/combustion are the same and combustion processes are the same when the engine is operated at different rpm.

Generally speaking, heat release rate is proportional to fuel injection rates. Then heat release rate and combustion chamber volume increase rate are both proportional to engine rpm. Therefore, the designed combustion process will not change appreciably with engine operation rpm. Furthermore, a cut-off of the combustion process near the tail portion for partial load conditions will not significantly influence the early portion. As a result, the designed combustion process will not be influenced significantly by engine power output change. For practical purposes, the combustion process under a constant pressure and limited temperature achieved at engine design conditions will not change with engine operation conditions.

Figure 8:
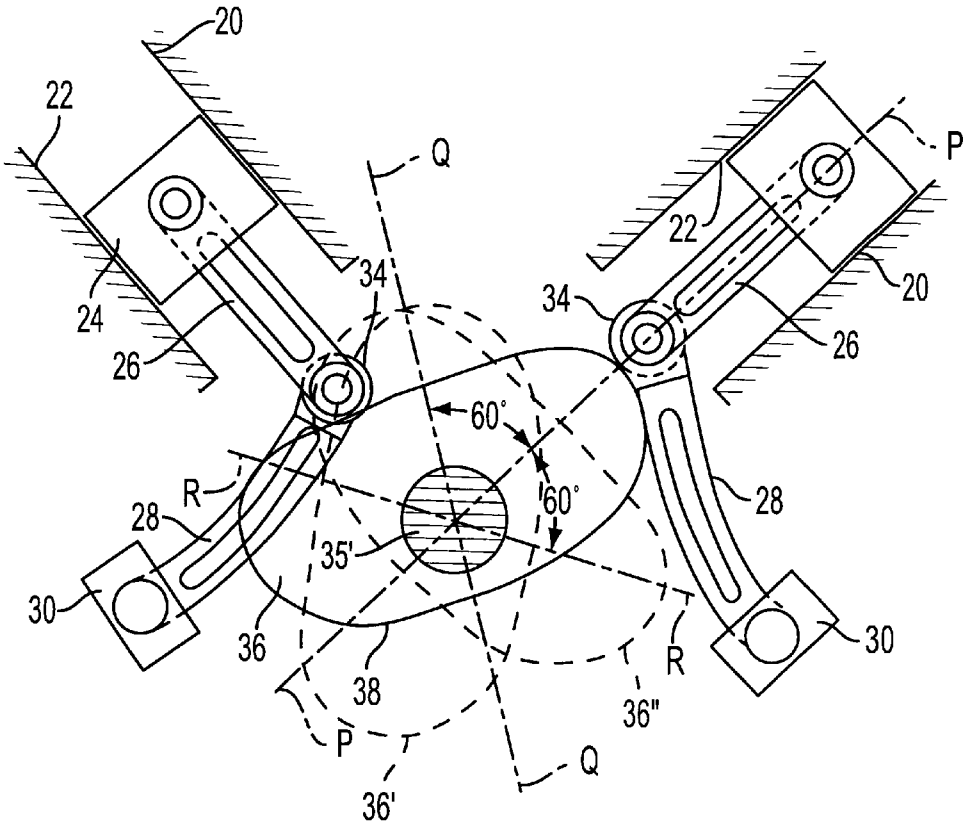
FIG. 8 shows in a diagrammatic manner a 6-cylinder engine with the cylinders arranged in three rows and two columns.

Referring to FIG. 8, the construction of a six-cylinder 4SDI engine utilizing the invention powertrain is illustrated. A pair of cylinders 20 along with the associated pistons 24, connecting rods 26, levers 28 and drive rollers 34 are shown as being supported by an engine body with the centerlines of the cylinders disposed at right angles to one another and with the levers being disposed in substantially the same plane. It is noted that the two cylinders are mirror images of one another. Each of the cylinders is provided with an auxiliary inlet valve for introducing compressed air into the cylinder above the associated piston. The operating means 30 function as described before to lock the associated levers in first and second operative positions for deactivating and activating the cylinders. The drive rollers 34 engage the peripheral cam surface 38 on member 36 which is fixed for rotation with output shaft 35'.

The two cylinders shown comprise one row of cylinders, a second parallel similar row of two cylinders (not shown) being disposed behind the row shown, and a third parallel similar row of two cylinders (not shown) being disposed behind the second row of cylinders. Therefore, six cylinders are arranged in two columns of three cylinders each, a first column being defined by the left-hand cylinder 20 as shown in FIG. 8 with two similar cylinders being disposed directly therebehind, and a second column being defined by the right-hand cylinder 20 as shown in FIG. 8 with two similar cylinders being disposed directly therebehind.

A second member 36' is similar to member 36 and is shown in phantom line for the sake of illustration. Member 36' is also fixed for rotation with output shaft 35'. Member 36' is disposed behind member 36 and lies in substantially the same plane as the levers and drive rollers of the second row of cylinders so as to cooperate with the components in the second row of cylinders in the same manner as those in the first row of cylinders. A third member 36" is similar to member 36 and is shown in dotted line for the sake of illustration. Member 36" is also fixed for rotation with output shaft 35'. Member 36" is disposed behind member 36' and lies in substantially the same plane as the levers and drive rollers of the third row of cylinders so as to cooperate with the components in the third row of cylinders in the same manner as those in the first row of cylinders.

A reference line P—P for member 36 passes through the axis of rotation of output shaft 35' and also defines the centerline of the right-hand cylinder 20 as seen in FIG. 8. Corresponding reference lines Q—Q and R—R are provided for members 36' and 36". These reference lines define the shaft angles of the three members 36, 36' and 36" respectively. The shaft angle of member 36' lags the shaft angle of member 36 by sixty degrees, and the shaft angle of member 36" leads the shaft angle of member 36 by sixty degrees as shaft 35' rotates in a clockwise direction.

The first order dynamic reciprocating forces of each column of the 6-cylinder engine are 120 degrees out of phase, and are therefore balanced. The magnitudes of higher order dynamic forces are negligible. When any one cylinder of the engine is deactivated, the eliminated dynamic force of that cylinder becomes the unbalanced force perpendicular to the rotation axis of the output shaft. When one or two rows of cylinders are deactivated, there is an unbalanced horizontal force perpendicular to the rotation axis of the output shaft. The rotary part of the powertrain is independently balanced. Because of its very large angular momentum, the perfectly balanced rotating part of the powertrain acts as an isolator to prevent unbalanced dynamic forces from the reciprocating part of the powertrain to reach the engine support. Therefore, the 6-cylinder 4SDI engine can operate on any number of cylinders without creating engine vibration problems. As mentioned before, modem mid-size sedans can maintain a highway speed of 70 mph with only one-third of the installed engine power. Operation of a 6-cylinder engine with two cylinders at full power instead of six cylinders at one-third of the power can reduce fuel consumption and engine emission by more than 20% due to the difference in mechanical efficiencies.

Each cylinder of the engine is individually mounted on the engine frame. The rotating part of the powertrain, which is supported on the engine frame by two ball bearings at opposite ends thereof has sufficient angular momentum to function as a flywheel. Needle bearings can be used to reduce friction at each end of the connecting rod. The only sliding motion is between the short piston skirt and cylinder wall where normal forces are very small. The difference in friction losses between a piston-crank assembly powertrain and the invention powertrain is very large. Since the invention eliminates the need for a crankshaft, a separate camshaft and a gear train, an engine utilizing the invention powertrain may be manufactured at significantly less cost than engines employing conventional powertrains.

The invention has been described with reference to a preferred embodiment. Obviously, various modifications, alternatives and other embodiments will occur to others upon reading and understanding this specification. It is my/our intention to include all such modifications, alternatives and other embodiments insofar as they come within the scope of the appended claims or equivalents thereof.

What is claimed is:

1. A piston engine powertrain comprising, an engine body, a cylinder supported by said engine body and having a centerline, a piston mounted for reciprocation within said cylinder, means for introducing compressed air into said cylinder above said piston, connecting rod having opposite ends, one of said ends being pivotally connected to said piston, a rotatable power output shaft, a member drivingly connected to said output shaft and having a cam surface thereon, a lever pivotally supported by said engine body, the opposite end of said connecting rod being pivotally connected to said lever, drive means rotatably supported on said lever, said lever being formed of strong elastic material, and operating means for selectively locking said lever in a first operative position wherein said drive means is out of contact with said cam surface and in a second operative position wherein the lever is deformed so as to act as a bar spring to urge said drive means into continuous contact with said cam surface as said output shaft and member connected thereto rotate, whereby the opposite end of the connecting rod deviates very little from said centerline as the piston reciprocates, and side forces generated between said drive means and said cam surface are transmitted through the lever to said engine body.

2. A powertrain as defined in claim 1 wherein said connecting rod is pivotally connected to said lever for pivotal movement about an axis, said drive means being rotatable about the same axis.

3. A powertrain as defined in claim 1 wherein said drive means comprises a pair of spaced drive rollers, said member having an annular groove formed in a central portion of the cam surface thereon to define a space for receiving said lever during certain periods of operation of the powertrain and forming two spaced identical cam surface portions, one of said drive rollers being engageable with one of said cam surface portions, and the other of said drive rollers being engageable with the other of said cam surface portions.

4. A powertrain as defined in claim 1 wherein said lever is pivotally supported by said engine body.

5. A powertrain as defined in claim 1 wherein said cam surface defines an intake portion, a compression portion, an expansion portion and an exhaust portion corresponding to the intake, compression, expansion and exhaust strokes of said piston, said cam surface being configured to provide unequal piston strokes.

6. A powertrain as defined in claim 5 wherein said intake and compression strokes are shorter than said expansion and exhaust strokes.

7. A powertrain as defined in claim 6 wherein said intake and compression portions have a first base circle, said expansion and exhaust portions having a second base circle, said first base circle having a greater diameter than said second base circle.

8. A powertrain as defined in claim 7 wherein said cam surface defines two lobes or a multiple of two lobes.

9. A piston engine powertrain comprising, an engine body, a plurality of cylinders supported by said engine body, each of said cylinders having a centerline, a plurality of pistons, each of said pistons being mounted for reciprocation within one of said cylinders, each of said cylinders including means for introducing compressed air into the cylinder above the associated piston, a plurality of connecting rods each of which has opposite ends, one of the ends of each of said connecting rod being connected to one of said pistons, a rotatable output shaft, a member drivingly connected to said output shaft and having a cam surface thereon, a plurality of levers each of which is movably supported by said engine body, the opposite ends of each of said connecting rods being pivotally connected to one of said levers, drive means rotatably supported on each of said levers, each of said levers being formed of strong elastic material, and operating means for independently selectively locking each of said levers in a first operative position wherein the drive means supported thereon is out of contact with said cam surface and in a second operative position wherein the lever is deformed so as to act as a bar spring to urge the drive means supported thereon into continuous contact with said cam surface as said output shaft and member connected thereto rotate, whereby the opposite ends of each of said connecting rods deviates very little from the centerline of the associated cylinder as the associated piston reciprocates, and side forces generated between each of said drive means and the associated cam surface are transmitted through the associated lever to said engine body.

10. A powertrain as defined in claim 9 wherein each connecting rod is pivotally connected to an associated lever for pivotal movement about an axis, said drive means supported on said associated lever being rotatable about the same axis.

11. A powertrain as defined in claim 9 wherein said drive means comprises a pair of spaced drive rollers, said member having an annular grove formed in a central portion of the cam surface thereon to define a space for receiving each of said levers during certain periods of operation of the powertrain and forming two spaced identical cam surface portions, one of said drive rollers or each of said drive means being engageable with one of said cam surface portions, and the other of said drive rollers of each of said drive means being engageable with the other of said cam surface portions.

12. A powertrain as defined in claim 9 wherein each of said levers is pivotally supported by said engine body.

13. A powertrain as defined in claim 9 wherein said cam surface defines an intake portion, a compression portion, an expansion portion and an exhaust portion corresponding to the intake, compression, expansion and exhaust strokes of each of said pistons, said cam surface being configured to provide unequal piston strokes of each of said pistons.

14. A powertrain as defined in claim 13 wherein said intake and compression strokes of each of said pistons are shorter than said expansion and exhaust strokes of each of said pistons.

15. A powertrain as defined in claim 14 wherein said intake and compression portions have a first base circle, said expansion and exhaust portions having a second base circle, said first base circle having a greater diameter than said second base circle.

16. A powertrain as defined in claim 13 wherein said cam surface defines two lobes or a multiple of two lobes.

17. A six cylinder engine comprising, an engine body, six cylinders supported by said engine body and arranged in three rows, each of said rows comprising two of said six cylinders, said six cylinders also being arranged in two columns, each of said columns comprising three of said six cylinders, each of said six cylinders having a centerline, six pistons each of which is reciprocally mounted within one of said cylinders, each of said cylinders including means for introducing compressed air into the cylinder above the associated piston, six connecting rods each of which has opposite ends, one of the ends of each of said connecting rods being connected to one of said pistons, a rotatable output shaft, three spaced members drivingly connected to said output shaft and each having a cam surface thereon, six levers each of which is movably supported by said engine body, the opposite ends of each of said connecting rods being pivotally connected to one of said levers, drive means rotatably supported on each of said levers, each of said rows including a pair of cylinders and associated pistons, connecting rods, levers and drive means, the drive means of each of said rows being engageable with the cam surface of one of said members connected to the output shaft, each of said levers being formed of strong elastic material, and operating means for independently selectively locking each of said levers in a first operative position wherein the drive means supported thereon is out of contact with the cam surface of an associated member connected to the output shaft and in a second operative position wherein the lever is deformed so as to act as a bar spring to urge the drive means supported thereon into continuous contact with the cam surface of the associated member connected to the output shaft as said output shaft rotates, whereby the opposite end of each connecting rod deviates very little from the centerline of the associated cylinder as the associated piston reciprocates, and side forces generated between each of said drive means and the associated cam surface are transmitted through the associated lever to said engine body.

18. An engine as defined in claim 17 wherein the two levers in each of said rows lie substantially in the same plane.

19. An engine as defined in claim 17 wherein each of said levers is pivotally supported by said engine body, the operating means for moving each of said levers comprising a device for pivoting the associated lever between said first and second operative positions.

20. An engine as defined in claim 17 wherein each of said members drivingly connected to said output shaft has a similar cam profile, the shaft angle of a first one of said cam profiles leading the shaft angle of a second one of said cam profiles by sixty degrees, and the shaft angle of a third one of said cam profiles lagging the shaft angle of said second one of said cam profiles by sixty degrees.

* * * * *